US009598906B2

(12) United States Patent
Heisig

(10) Patent No.: US 9,598,906 B2
(45) Date of Patent: Mar. 21, 2017

(54) METHOD AND APPARATUS FOR VIBRATING HORIZONTAL DRILL STRING TO IMPROVE WEIGHT TRANSFER

(75) Inventor: Gerald Heisig, Houston, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 980 days.

(21) Appl. No.: 13/556,015

(22) Filed: Jul. 23, 2012

(65) Prior Publication Data

US 2013/0186686 A1 Jul. 25, 2013

Related U.S. Application Data

(60) Provisional application No. 61/510,595, filed on Jul. 22, 2011.

(51) Int. Cl.

| | |
|---|---|
| ***E21B 7/24*** | (2006.01) |
| ***E21B 4/02*** | (2006.01) |
| *E21B 28/00* | (2006.01) |

(52) U.S. Cl.

CPC ..... *E21B 7/24* (2013.01); *E21B 4/02* (2013.01); *E21B 28/00* (2013.01)

(58) Field of Classification Search

CPC ... E21B 7/24; E21B 4/02; E21B 28/00; E02D 7/18

USPC ..... 175/55, 56, 101, 107; 166/178, 177.6

See application file for complete search history.

(56) References Cited

U.S. PATENT DOCUMENTS

| | | | | |
|---|---|---|---|---|
| 4,384,625 | A * | 5/1983 | Roper et al. | 175/56 |
| 4,667,742 | A * | 5/1987 | Bodine | E21B 7/24 166/301 |
| 4,815,328 | A * | 3/1989 | Bodine | B06B 1/167 366/128 |
| 4,890,682 | A * | 1/1990 | Worrall et al. | 175/61 |
| 5,543,714 | A | 8/1996 | Blanpain et al. | |
| 5,960,370 | A | 9/1999 | Towle et al. | |
| 6,009,948 | A * | 1/2000 | Flanders et al. | 166/301 |
| 6,561,290 | B2 * | 5/2003 | Blair et al. | 175/107 |
| 6,571,870 | B2 | 6/2003 | Zheng et al. | |
| 7,136,510 | B2 | 11/2006 | Van Ginkel et al. | |
| 7,191,852 | B2 * | 3/2007 | Clayton | 175/55 |
| 2005/0230101 | A1 * | 10/2005 | Zheng et al. | 166/177.6 |
| 2009/0266612 | A1 * | 10/2009 | Allahar et al. | 175/55 |

(Continued)

FOREIGN PATENT DOCUMENTS

| | | | | |
|---|---|---|---|---|
| GB | 2469866 B | * | 3/2010 | E21B 28/00 |
| RU | 2186926 C1 | | 8/2002 | |

OTHER PUBLICATIONS

G. Heisig, Lateral Drillstring Vibrations in Extended-Reach Wells, IADC/SPE 59235, 2000 IADC/SPE Drilling Conference; new Orleans, La Feb. 23-25, 2000.*

(Continued)

*Primary Examiner* — Waseem Moorad

*Assistant Examiner* — Christopher Sebesta

(74) *Attorney, Agent, or Firm* — Adolph Locklar

(57) ABSTRACT

An apparatus for use in a horizontal section of a drill string is disclosed. The apparatus includes a motor that is connected to the horizontal section of the drill string. The motor is adapted to impart vibrations in the horizontal section of the drill string, where the vibrations are at about the lateral resonant frequency of the horizontal section of the drill string.

15 Claims, 4 Drawing Sheets

(56) References Cited

U.S. PATENT DOCUMENTS

| | | | | |
|---|---|---|---|---|
| 2010/0038142 | A1* | 2/2010 | Snyder et al. | 175/107 |
| 2010/0224412 | A1 | 9/2010 | Allahar | |
| 2011/0079383 | A1 | 4/2011 | Porter | |

OTHER PUBLICATIONS

Dinctionary Definition "Lateral"; http://dictionary.reference.com/browse/lateral.*

Schlumberger; Drillstring Vibrations and Vibration Modeling, 2010.*

International Search Report and Written Opinion for International Application No. PCT/US13/58910, mailed on Feb. 7, 2014 (9 pages).

International Search Report issued in PCT/US2012/047884, dated Oct. 23, 2012, 2 pages.

* cited by examiner

METHOD AND APPARATUS FOR VIBRATING HORIZONTAL DRILL STRING TO IMPROVE WEIGHT TRANSFER

BACKGROUND OF THE DISCLOSURE

This disclosure relates to downhole vibration tools, more particularly, a method and a tool for vibrating a long section of a drill string in a horizontal well bore.

Modern drilling techniques frequently include highly inclined and horizontal sections of drill string. As a result, the highly inclined and horizontal sections of drill string tend to rest at multiple positions along the bottom of the borehole. Because the drill string is in contact with a side of the bore hole, it is possible for this contact to result in poor weight transfer along the drill string.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily reduced for clarity of discussion.

DESCRIPTION OF THE EMBODIMENTS

Figure 1:
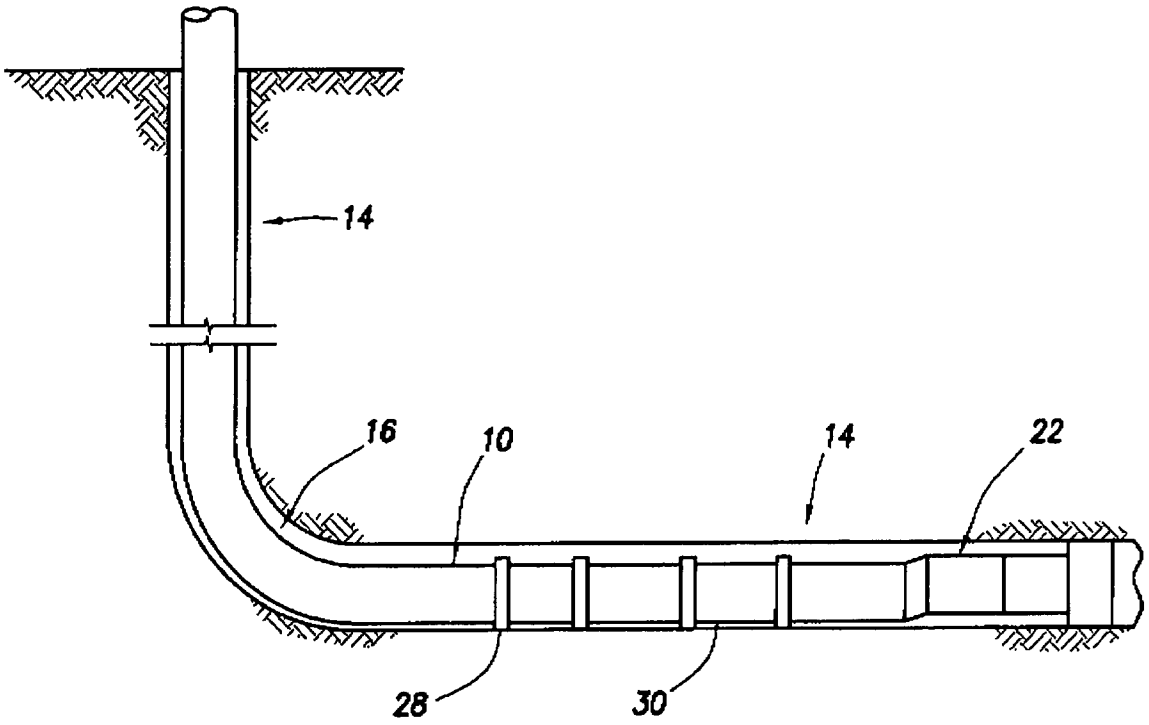
FIG. 1 is an illustration of a drill string in a well bore that is partially vertical and partially horizontal.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The present disclosure relates to a method and apparatus for laterally vibrating a horizontal section of drill string. In this disclosure "horizontal section of drilling string" is defined as drill string at an angle of 60 degrees or greater with respect to the vertical, i.e., a line from the surface of the earth to the center of the earth. Typically, the horizontal section of drilling string rests at multiple points of the bottom of the borehole. The bottom of the borehole is the side of the borehole closest to the center of the earth. In certain embodiments, the horizontal section of the drill string may be under compression. These horizontal sections of drill string may be hundreds or thousands of feet long. Because of the positioning and compression of the horizontal section of the drill string, poor weight transfer along the horizontal section of drill string may result, creating difficulties in properly drilling the borehole.

In certain embodiments of the present disclosure, a motor is used to create lateral vibrations in the horizontal sections of drill string. These lateral vibrations may have the effect of creating a serpentine movement of the horizontal section of drill string, resulting in better weight transfer along the horizontal section of drill string.

The frequency of the lateral vibrations has an effect on the efficiency in causing effective weight transfer. Frequencies that are too high may be dampened by contact with the borehole walls or by the drill string itself. In certain embodiments of the present disclosure, the frequency at which the motor vibrates the drill string is about the lateral resonant frequency of the horizontal section of the drill string. In certain other embodiments of the present disclosure, the frequency at which the motor vibrates the drill string is about the lowest lateral resonant frequency of the horizontal section of the drill string.

One non-limiting method of determining the lateral resonant frequencies, such as the lowest lateral resonant frequency, of the horizontal section of the drill string is described in IADC/SPE 59235 "Lateral Drilling String Vibrations in Extended Reach Wells", G. Heisig & M. Neubert (2000) (hereinafter Heisig), which is fully incorporated herein by reference. This non-limiting method includes, but is not limited to, FIG. 2A and found at equation (3) on page of Heisig:

$$f_{min} = \frac{1}{2\pi}\sqrt{\frac{q}{r\mu} - \frac{F^2}{4EI\mu}}.$$

wherein q is the buoyant weight, r is the radial clearance between drilling drillstring and wellbore, F is the axial force on the drill, μ is the vibrating mass per unit length, and EI is the bending stiffness of the drill string.

As one of ordinary skill in the art will recognize with the benefit of this disclosure, the horizontal section of the drill string is in a dynamic environment for which not all parameters related to resonant frequencies and damping characteristics may be determinable. Thus, the lateral resonant frequency determined by calculation may necessarily be an estimate with a certain degree of error. Further, because of limitations of downhole equipment, such as the motor used to induce the vibrations, it may not be possible to induce the precise lateral resonant frequency desired. Therefore, in certain embodiments "about" the lateral resonant frequency refers to this imprecision.

In certain embodiments of the present disclosure, the lowest lateral resonant frequency of the horizontal drill string is between 1 and 10 Hz. In certain other embodiments of the present disclosure, the lowest lateral resonant frequency of the horizontal drill string is between 2 and 5 Hz.

In certain embodiments of the present disclosure, the apparatus for laterally vibrating the horizontal section of the drill string is a motor, such as an electric motor or mud motor. The environment in one aspect of the present disclosure is depicted in FIG. 1.

FIG. 1 depicts one or more horizontal drill string sections 28 of drill string 10, which is lying on the bottom side of a substantially horizontal or highly inclined well bore of extended reach well 14. Horizontal drill string sections 28 typically include a multiplicity of drill string pipe sections 30 coupled together at joints, and may include wear knots between the joints thereof. Drill string pipe sections 30 are coupled together and at least several of the coupled pipe sections define a horizontal drill string section 28 of drill string assembly 16. Drill string assembly 16 typically includes a bottom hole assembly (BHA) 22 at the low end or removed end thereof.

Figure 2:
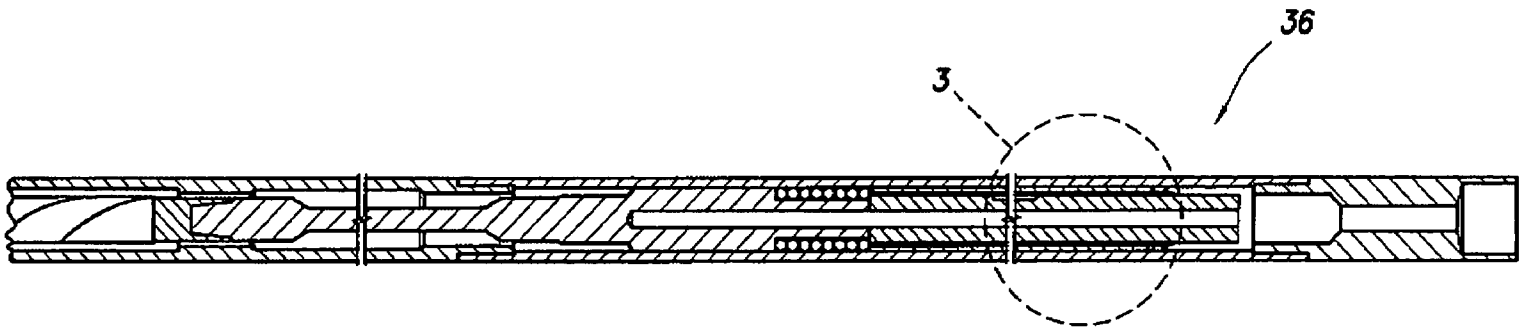
FIG. 2 is a mud motor for laterally vibrating the horizontal section of the drill string in accordance with an embodiment of the present disclosure.

In one embodiment of the present disclosure, the apparatus for vibrating the horizontal section of the drill string is motor 36, shown in FIG. 2 that is part of BHA 22. As described above, motor 36 may be an electrical or mud motor, for example. In certain embodiments of the present disclosure, motor 36, as illustrated in FIGS. 2, 3, and 4 induces a lateral frequency to the horizontal as a result of an imbalance.

Figure 3:
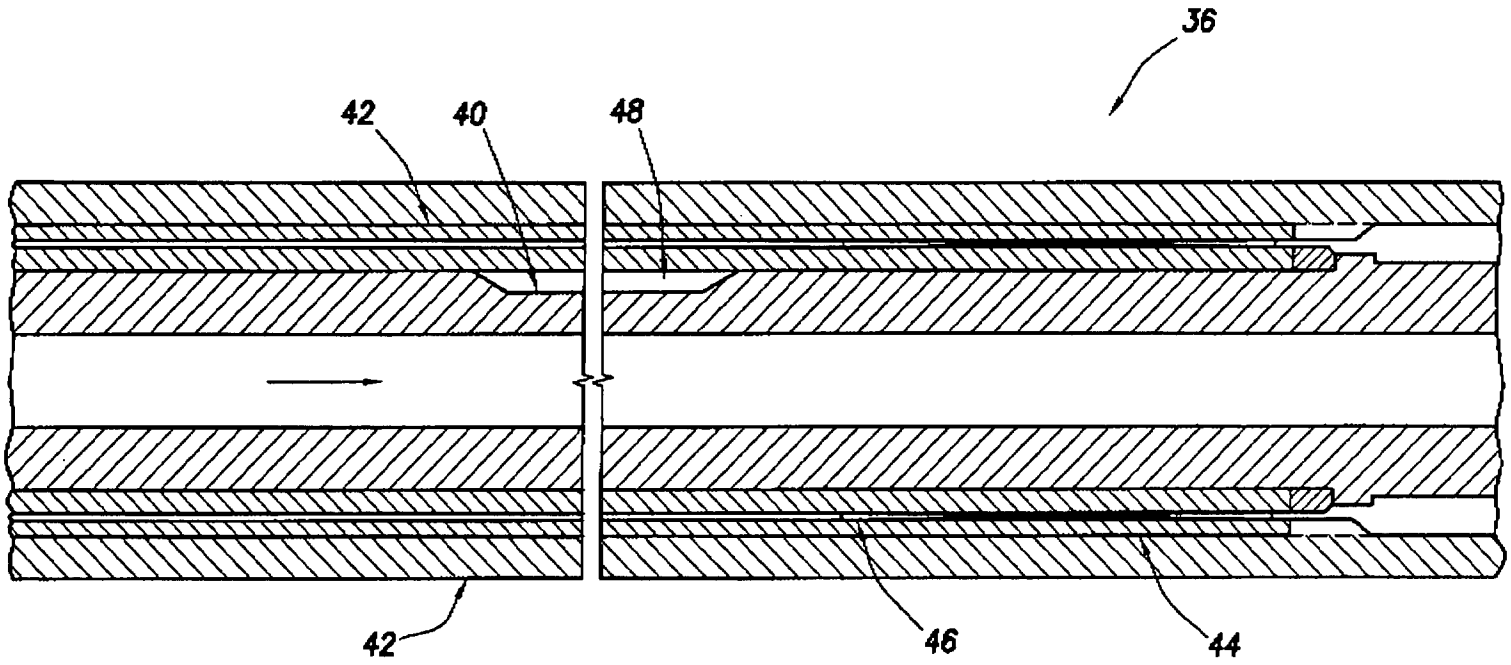
FIG. 3 is a cross-sectional partial view of mud motor for laterally vibrating the horizontal section of the drill string in accordance with one embodiment of the present disclosure of FIG. 2.
Figure 4:
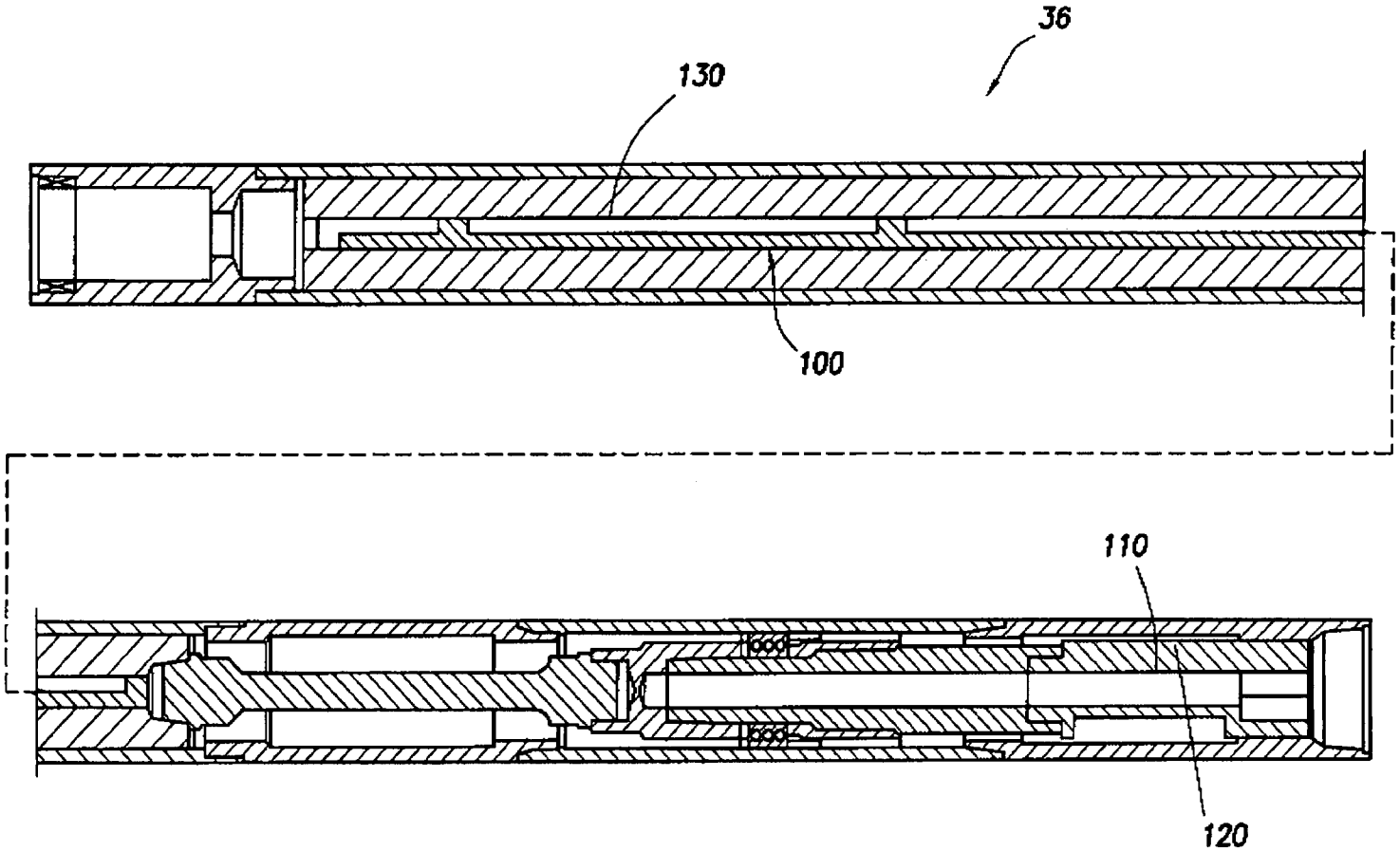
FIG. 4 is a mud motor for laterally vibrating the horizontal section of the drill string in accordance with an embodiment of the present disclosure

FIGS. 2 & 3 depict a mud motor in accordance with certain embodiments of the present disclosure. FIG. 3 depicts the drive train section of motor 36 with bearing housing 42, lower outer radial bearing 44, lower inner radial bearing 46, and lower outer spacer 50. FIG. 3 further includes mandrel 40 with imbalance 48.

A drilling fluid, generally referred to as drill mud, is circulated to drive the mud motor by positive hydraulic displacement or turbine action. Bearing assemblies are provided for the power transmission or drive train engaged to the rotor and stator of a power section for converting eccentric motion to concentric motion. As seen in FIGS. 2 and 3, motor 36 may include a drive train that may include a hollow drive shaft, also known as a mandrel 40, that is located within bearing housing 42. Mandrel 40 is rotatably driven by the power section of motor 36, while bearing housing 42 is fixed to the drill string and remains relatively stationary. Here, the drive train includes the bearing housing 42 having a lower outer spacer 50 concentrically within bearing housing 42. Bearing housing 42, at a lower end thereof, engages lower outer radial bearing 44 with lower inner radial bearing 46 on the inner surface thereof. Mandrel 40 has one or more partial cutouts 48 providing an imbalance when the mandrel rotates. Mandrel 40 is driven concentrically by engagement with the rotor but, with the cutout 48 therein, an imbalance is provided which may generate lateral flexing in the long section of the drill string, as set forth hereinabove. It is noted with reference to FIG. 3 that cutout 48 creates an eccentricity in the mandrel as it has no opposed cutout. While cutout 48 is shown in the external walls of the mandrel, one or more cutouts may be provided to the inner walls or any other suitable place appropriately arranged. In another embodiment, added mass (not shown) eccentrically added on the inner walls of the mandrel may also be provided to generate imbalance.

By controlling mud flow through motor 36 of FIGS. 2 & 3, the frequency of lateral vibration can be controlled.

In one embodiment of the present disclosure consistent with FIGS. 2 and 3, the flow of drilling mud through motor 36 may be controlled from the surface. In this embodiment, the operator determines the mud flow necessary to impart the desired lateral frequency, such as the lowest lateral resonant frequency, based on the imbalance on the mandrel.

In another embodiment of the present disclosure consistent with FIGS. 2 and 3, a bypass nozzle upstream of the power section (not shown) and having a multiplicity of bypass nozzle settings may be provided for engagement with the motor 36, such as that illustrated in FIGS. 2-3. The bypass nozzle may bypass mud through the center of the rotor. A control algorithm may be provided to determine the nozzle valve setting to generate frequencies in the selected range. In addition, control means may be included to dynamically adjust the valve nozzle to the determined setting, which setting maximizes the amplitude so as to substantially maintain the excitation means at a frequency in the desired range.

In still other embodiments, a rod may be longitudinally inserted into the rotor. The rod may be eccentric, i.e., not round. For instance, in one non-limiting embodiment, the cross-section of the rod is of a half-moon shape. In certain of this embodiment, mandrel 40 may not have cutout sections or weight added to it.

In other embodiments, in addition to or, in lieu of BHA 22 location of motor 36, motor 36 may be located at other points along horizontal drill string sections 28. Multiple motors 26 may be used in longer horizontal drill string sections 28.

In certain embodiments of the present disclosure a measurement device, for example, an accelerometer or a bending strain gauge, may be provided for monitoring of the amplitude of the laterally vibrating horizontal section 28. This measurement device may be mechanically attached to horizontal section 28 or to motor 36, for example. Further, the measurement device may be electrically connected to a control system, wherein the control system is adapted to adjust the motor to impart the lateral resonant frequency based on the frequency of the lateral vibrations of the horizontal section determined by the measurement device.

FIG. 4 depicts another embodiment of the present disclosure. In the embodiment depicted in FIG. 4, motor 36 includes shaft 130. Eccentric mass rotor insert 100 is attached to drive shaft 130. Lower eccentric mass 120 is also attached to drive shaft 130. The approximate location of mass centroid 110 is further depicted in FIG. 4. Eccentric mass rotor insert 100 and lower eccentric mass 120 are set 180 degrees apart, that is on opposite sides of drive shaft 130. While not bound by theory, the placement of the eccentric masses on opposite sides of the drive shafts results in a vibration node between the two masses.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. An apparatus for use in a horizontal section of a drill string comprising:

a motor, wherein the motor is connected to the horizontal section of the drill string; and a mandrel, the mandrel being a hollow shaft, the mandrel having a longitudinal axis, the mandrel having an imbalance, the imbalance including two eccentric masses attached to the mandrel, wherein the two eccentric masses are attached such that one eccentric mass is lower along the mandrel than the other eccentric mass, wherein the masses are about 180° apart on opposite sides of the mandrel with respect to the longitudinal axis, wherein the motor rotates the mandrel to impart lateral vibrations in the horizontal section of the drill string and wherein the vibrations are at about a lateral resonant frequency of the horizontal section of the drill string.

2. The apparatus of claim 1, wherein the vibrations are imparted generally at the lowest lateral resonant frequency.

3. The apparatus of claim 2, wherein the vibrations are in the frequency range of 1 to 10 Hz.

4. The apparatus of claim 3, wherein the vibrations are in the frequency range of 2 to 5 Hz.

5. The apparatus of claim 1, wherein the motor is a mud motor or an electrical motor.

6. A mud motor for use in a horizontal section of a drill string comprising:

a rotor;

a stator engaged with the rotor adapted to cause a drive train coupled to the rotor to rotate at a rotary speed;

a mandrel mechanically connected to the drive train, the mandrel being a hollow shaft, the mandrel having a longitudinal axis; and two eccentric masses attached to the mandrel to provide an imbalance to the mandrel, wherein the two eccentric masses are attached such that one eccentric mass is lower along the mandrel than the other eccentric mass, wherein the eccentric masses are about 180° apart on opposite sides of the mandrel with respect to the longitudinal axis wherein the mandrel is adapted to generate lateral vibrations in the horizontal section of the drill string in a selected frequency range of 1 to 10 Hz.

7. The apparatus of claim 6, wherein the two eccentric masses are positioned on the inner surface of the mandrel.

8. A process for generating lateral vibrations in a horizontal section of a drill string comprising;

supplying a motor, wherein the motor is mechanically connected to the horizontal section of the drill string;

operating the motor to rotate a mandrel having an imbalance, the mandrel being a hollow shaft, the mandrel having a longitudinal axis, so as to cause the horizontal section of the drill string to vibrate laterally in reference to the longitudinal axis of the drill string, wherein the vibrations are at about a lateral resonant frequency of the horizontal section of the drill string, wherein the imbalance of the mandrel is provided by two eccentric masses attached to the mandrel wherein the two eccentric masses are attached such that one eccentric mass is lower along the mandrel than the other eccentric mass, wherein the eccentric masses are about 180° apart on opposite sides of the mandrel with respect to the longitudinal axis.

9. The process of claim 8, wherein the lateral resonant frequency is the lowest lateral resonant frequency.

10. The process of claim 9, wherein the lowest lateral resonant frequency is calculated using the formula:

$$f_{min} = \frac{1}{2\pi}\sqrt{\frac{q}{r\mu} - \frac{F^2}{4EI\mu}}.$$

wherein q is the buoyant weight, r is the radial clearance between drilling drillstring and wellbore, F is the axial force on the drill, μ is the vibrating mass per unit length, and EI is the bending stiffness of the drill string.

11. The process of claim 9, wherein the vibrations are in the frequency range of 1 to 10 Hz.

12. The process of claim 11, wherein the vibrations are in the frequency range of 2 to 5 Hz.

13. The process of claim 8, wherein the motor is an electric motor or a mud motor.

14. The process of claim 8, further comprising:

monitoring the frequency of the lateral vibrations of the horizontal section.

15. The process of claim 14, further comprising:

supplying a control system, wherein the control system is adapted to adjust the motor to impart the lateral resonant frequency based on the frequency of the lateral vibrations of the horizontal section determined by the monitoring step.

* * * * *